US010815628B2

(12) United States Patent
Jackson et al.

(10) Patent No.: US 10,815,628 B2
(45) Date of Patent: Oct. 27, 2020

(54) BRIDGE OVERHANG BRACKET ASSEMBLY WITH CONNECTION ELEMENT

(71) Applicants: Barry Walter Jackson, Mississauga (CA); David George Jackson, Mississauga (CA)

(72) Inventors: Barry Walter Jackson, Mississauga (CA); David George Jackson, Mississauga (CA)

( * ) Notice: Subject to any disclaimer, the term of this patent is extended or adjusted under 35 U.S.C. 154(b) by 0 days.

(21) Appl. No.: 16/660,886

(22) Filed: Oct. 23, 2019

(65) Prior Publication Data

US 2020/0131723 A1 Apr. 30, 2020

Related U.S. Application Data

(60) Provisional application No. 62/750,936, filed on Oct. 26, 2018.

(51) Int. Cl.
*E01D 21/00* (2006.01)
*E01D 19/12* (2006.01)
*E01D 101/24* (2006.01)

(52) U.S. Cl.
CPC ..... *E01D 21/00* (2013.01); *E01D 19/125* (2013.01); *E01D 2101/24* (2013.01)

(58) Field of Classification Search
CPC ... E01D 19/125; E01D 21/00; E01D 2101/24; E04G 17/00
USPC ..... 14/74.5, 77.1, 78, 71.3; 249/24, 211; 52/73
See application file for complete search history.

(56) References Cited

U.S. PATENT DOCUMENTS

| | | | | |
|---|---|---|---|---|
| 2,195,579 | A | 4/1940 | Murdock | |
| 2,414,538 | A | 1/1947 | Lamb | |
| 3,119,590 | A | 1/1964 | Eriksson | |
| 3,782,676 | A * | 1/1974 | Boll | E04G 11/38 249/23 |
| 4,470,574 | A | 9/1984 | Jackson | |
| 5,112,155 | A | 5/1992 | Jackson | |
| 5,273,415 | A | 12/1993 | Jackson | |
| 5,310,153 | A | 5/1994 | Jackson | |
| 5,318,148 | A | 6/1994 | Franco et al. | |
| 5,326,065 | A | 7/1994 | Jackson | |
| 5,524,854 | A | 6/1996 | McSwain et al. | |

(Continued)

FOREIGN PATENT DOCUMENTS

| | | |
|---|---|---|
| CA | 2122736 A1 | 5/1993 |
| CA | 2130119 C | 8/1993 |

(Continued)

*Primary Examiner* — Raymond W Addie
(74) *Attorney, Agent, or Firm* — Bereskin & Parr LLP/S.E.N.C.R.L., s.r.l.

(57) ABSTRACT

A bridge overhang bracket assembly includes a top member having an upper surface. The top member and a diagonal member are pivotally attached proximate to respective distal and upper ends thereof. The diagonal member and a side member are pivotally attached proximate to respective lower and bottom ends thereof. A connection element is mounted to the top member and is pivotally attached to a top end of the side member. The connection element is translatable along the top member to adjust a longitudinal position of the connection element relative to the top member. The connection element does not extend above the upper surface of the top member.

20 Claims, 14 Drawing Sheets

(56) References Cited

U.S. PATENT DOCUMENTS

| | | | | |
|---|---|---|---|---|
| 5,755,981 | A * | 5/1998 | Payne | E01D 21/00 249/24 |
| 5,813,185 | A | 9/1998 | Jackson | |
| 5,865,410 | A * | 2/1999 | Horen | E04G 5/062 248/242 |
| 6,059,258 | A | 5/2000 | Jackson | |
| 6,065,254 | A | 5/2000 | Lanka | |
| 7,032,268 | B2 | 4/2006 | Jackson | |
| 7,159,262 | B2 | 1/2007 | Jackson | |
| 7,360,341 | B2 | 4/2008 | Jackson et al. | |
| 8,529,157 | B2 | 9/2013 | McKay | |
| 10,508,392 | B2 | 12/2019 | Jackson et al. | |
| 10,633,873 | B2 * | 4/2020 | Siltala | E04G 3/243 |
| 2001/0037614 | A1 | 11/2001 | Hambelton | |
| 2005/0217040 | A1 * | 10/2005 | Jackson | E01D 21/00 14/77.1 |
| 2008/0111040 | A1 | 5/2008 | Jackson et al. | |
| 2013/0170941 | A1 | 7/2013 | Drott et al. | |
| 2019/0106891 | A1 | 4/2019 | Jackson et al. | |
| 2019/0226165 | A1 | 7/2019 | Jackson et al. | |

FOREIGN PATENT DOCUMENTS

| | | | |
|---|---|---|---|
| CA | 2138795 | A1 | 4/1994 |
| CA | 2130451 | C | 7/1994 |
| CA | 2118170 | A1 | 4/1996 |
| CA | 2203978 | C | 10/1997 |
| CA | 2249921 | C | 4/1999 |
| CA | 2440612 | A1 | 3/2004 |
| CA | 2444449 | C | 4/2005 |
| CA | 2496089 | A1 | 8/2006 |
| CA | 2534944 | C | 8/2006 |
| GB | 2146687 | A | 4/1985 |
| GB | 2146728 | A | 4/1985 |
| WO | 9309311 | A1 | 5/1993 |
| WO | 9316253 | A1 | 8/1993 |
| WO | 9415045 | A1 | 7/1994 |
| WO | 9425705 | A2 | 11/1994 |

* cited by examiner

BRIDGE OVERHANG BRACKET ASSEMBLY WITH CONNECTION ELEMENT

CROSS-REFERENCE TO RELATED APPLICATION

This application claims priority to U.S. Provisional Application No. 62/750,936 filed on Oct. 26, 2018, the entire contents of which are hereby incorporated herein by reference.

FIELD

The present disclosure relates generally to shoring devices, for example, brackets used for bridge overhangs.

BACKGROUND

The following paragraphs are not an admission that anything discussed in them is prior art or part of the knowledge of persons skilled in the art.

U.S. Pat. No. 7,032,268 discloses a bridge overhang bracket that includes an elongate top member having inner and outer ends an elongate diagonal member having an inner end and an outer end, the outer end of the diagonal member pivotally attached to the outer end of the top member, upper and lower pivot joints secured to the top member and diagonal member, respectively, adjacent the respective inner ends thereof, and an elongate side member extending between and engaged with the upper and lower pivot joints. At least one of the pivot joints comprises an adjustable axial engagement mechanism for adjusting the position along the length of the side member at which the at least one pivot joint engages the side member.

U.S. Pat. No. 7,159,262 discloses an overhang bracket that has a top member, a side member and a diagonal member. The side and top member may be connected together through a removable connecter. A guardrail post holder allows a guardrail post to be installed at a variety of angles to the top member. Rotating the side member causes the diagonal member to translate up or down the side member. A side member locator extends upwards from the overhang bracket to indicate the location of the side member. A tie rod holder holds a tie rod in an offset position relative to the side member. The side member locator may extend upwards through further parts of the shoring system or bridge overhang structure, for example a floor of a concrete form or rebar. A worker may adjust the overhang bracket in place from a standing position on a supporting structure or the floor of the form.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Various apparatuses or methods will be described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below, or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

The present disclosure relates to bridge overhang brackets. Bridge overhang brackets are described in U.S. Pat. Nos. 7,032,268 and 7,159,262 and application Ser. No. 15/726,513 and 62/619,339, and the entire contents of each are hereby incorporated herein by reference.

Figure 1:
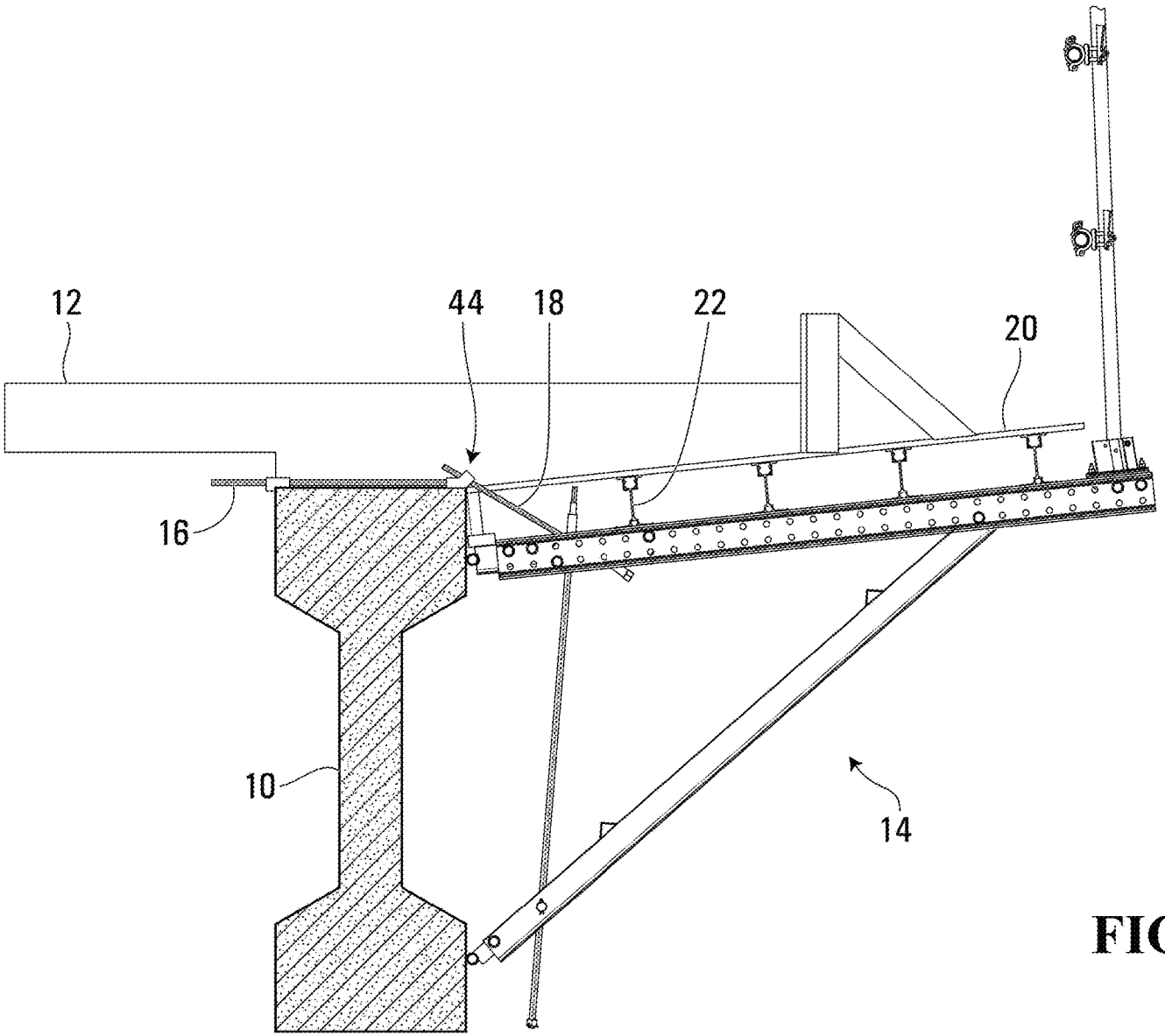
FIG. 1 is a side view of an example of a bridge bracket overhang assembly installed onto a bridge girder/beam.

FIG. 1 shows a concrete beam or girder 10 supporting a bridge deck 12. An example of an improved bridge overhang bracket assembly is shown generally at reference numeral 14. A hanger rod 16 is affixed to the beam 10, and a tie bar 18 couples the hanger rod 16 and the assembly 14. A bridge deck support form 20 acts as a temporary support surface for the bridge deck 12 during the forming process. The bridge deck support form 20 is connected to the assembly 14 by joist beams 22.

Figure 2:
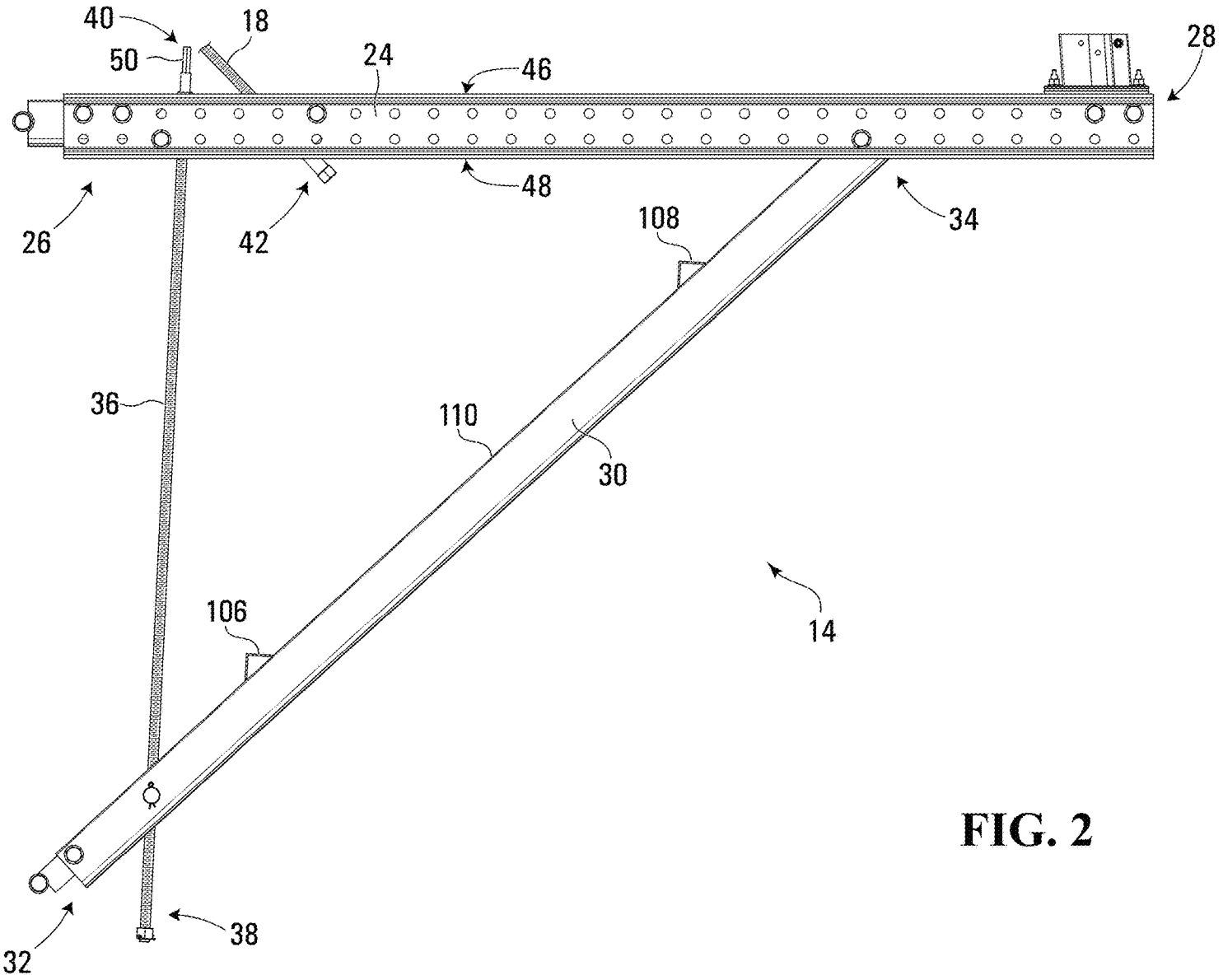
FIG. 2 is a side view of the assembly of FIG. 1.

Referring to FIG. 2, in the example illustrated, the assembly 14 has four elongate members, namely, a top member 24 extending lengthwise between proximal and distal ends 26, 28, a diagonal member 30 extending lengthwise between lower and upper ends 32, 34, a side member 36 extending lengthwise between bottom and top ends 38, 40, and a tie bar 18 extending lengthwise between ends 42, 44 (FIG. 1). The top member 24 is shown to include upper and lower surfaces 46, 48. An upper end of the side member 36 is shown to include a gripping surface 50 that can facilitate using a tool to rotate the side member 36, and the end 42 of the tie bar 18 can include a similar gripping surface facilitate using a tool to rotate the tie bar 18.

The terms top, diagonal and side are used herein to assist in describing the assembly 14, and are not intended to be limiting. In some examples, the top and side members 24, 36 can depart significantly from the horizontal and vertical, respectively.

In the example illustrated, the top and diagonal members 24, 30 are pivotally attached proximate to the distal and upper ends 28, 34, and the diagonal and side members 30, 36 are pivotally attached proximate to the lower and bottom ends 32, 38. In use, ends 26, 32 are nearest the beam or other supporting structure (not shown in FIG. 2), while the ends 28, 34 are the outboard ends of the respective top and diagonal members 24, 30, furthest from the beam.

Figure 3:
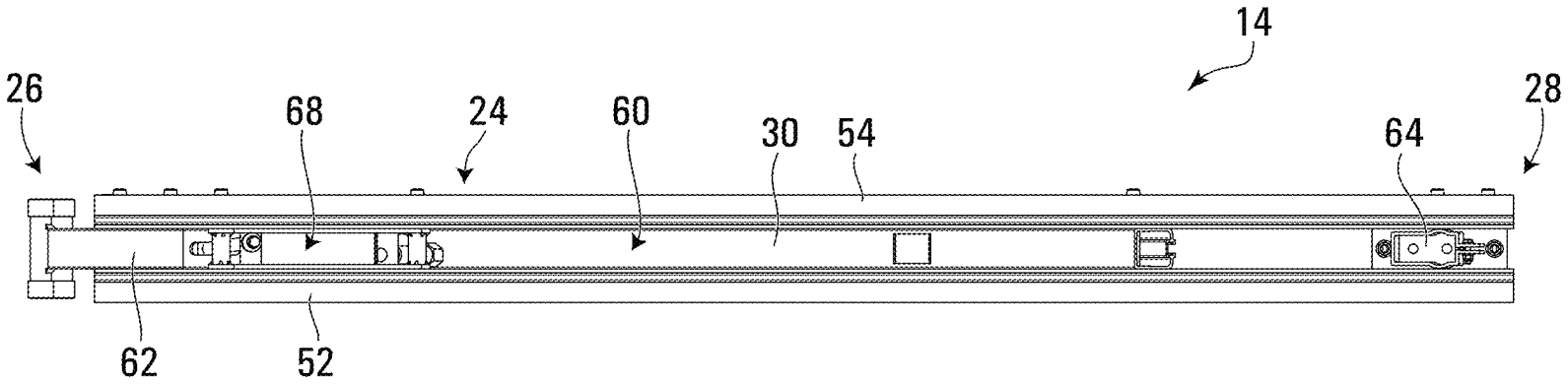
FIG. 3 is a top view of the assembly of FIG. 1 with a side member and tie bar removed.
Figure 4:
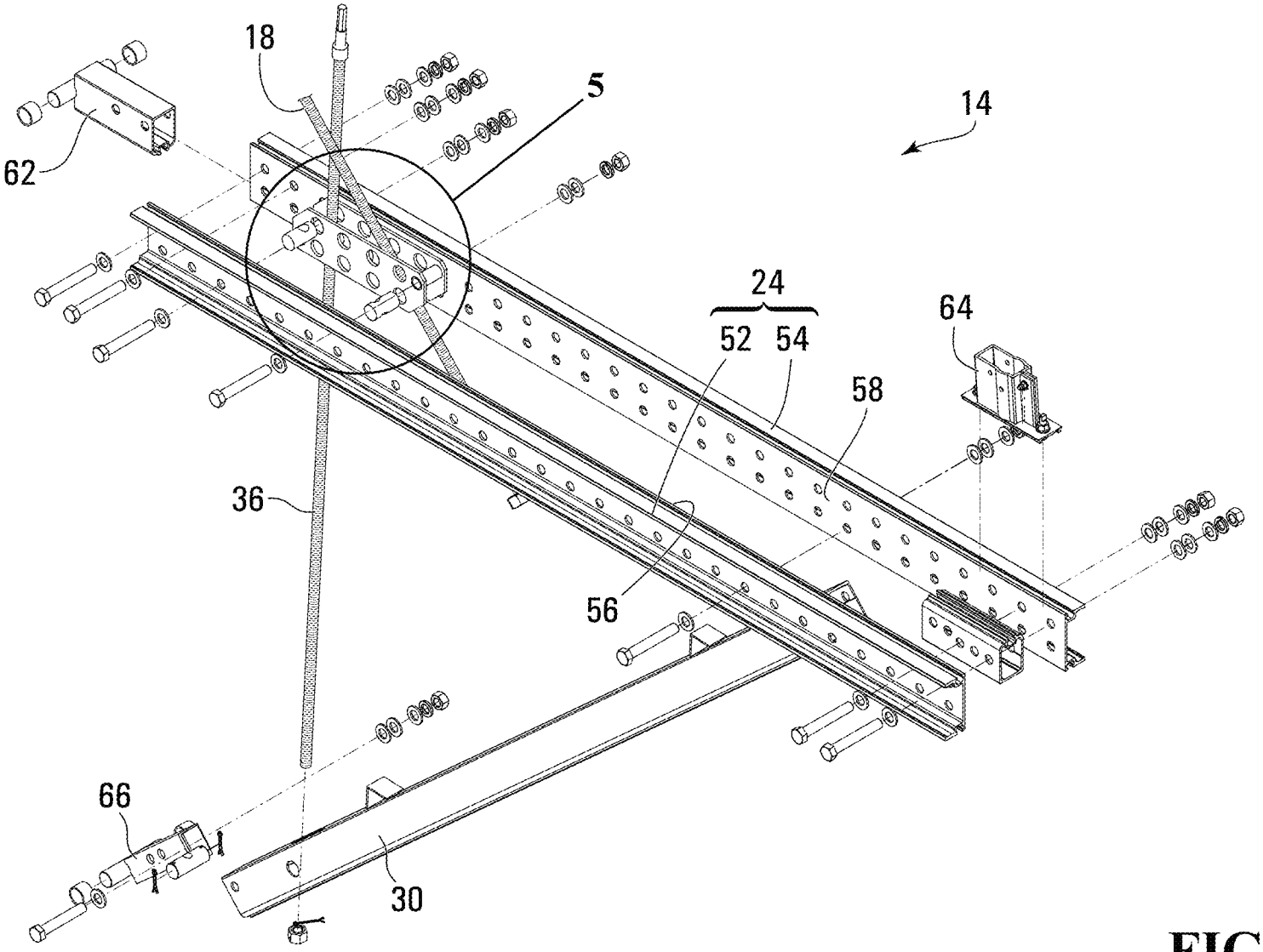
FIG. 4 is an exploded view of the assembly of FIG. 1.

Referring to FIGS. 3 and 4, the top member 24 is shown to consist of first and second channel members 52, 54, which are arranged in parallel. The first channel member 52 has an inner surface 56 and the second channel member 54 has an inner surface 58. In the example illustrated, the inner surface 56 is facing and spaced laterally from the inner surface 58 to define a slot 60. In the example illustrated, a first bumper 62 and a guard post holder 64 are positioned between the channel members 52, 54. A second bumper 66 is received by the lower end of the diagonal member 30. FIG. 4 further illustrates hardware for securing the components together.

Referring to FIGS. 3, 4, 5 and 6, the assembly 14 includes a connection element 68 mounted to the top member 24. In the example illustrated, the connection element 68 is disposed within the slot 60 between the first and second channel members 52, 54. The connection element 68 is translatable along the top member 24 between the proximal and distal ends 26, 28 for adjusting a longitudinal position of the connection element 68 relative to the top member 24.

The connection element 68 is shown in FIGS. 7, 8, 9, 10 and 11. In the example illustrated, the connection element 68 includes a first plate 70 and a second plate 72, which are joined by supports 74. The first plate 70 includes inner and outer surfaces 76, 78 and the second plate 72 includes inner and outer surfaces 80, 82. In use, the outer surface 78 of the first plate 70 engages the inner surface 56 of the first channel member 52 and the outer surface 82 of the second plate 72 engages the inner surface 58 of the second channel member 54 (FIG. 4).

Figure 6:
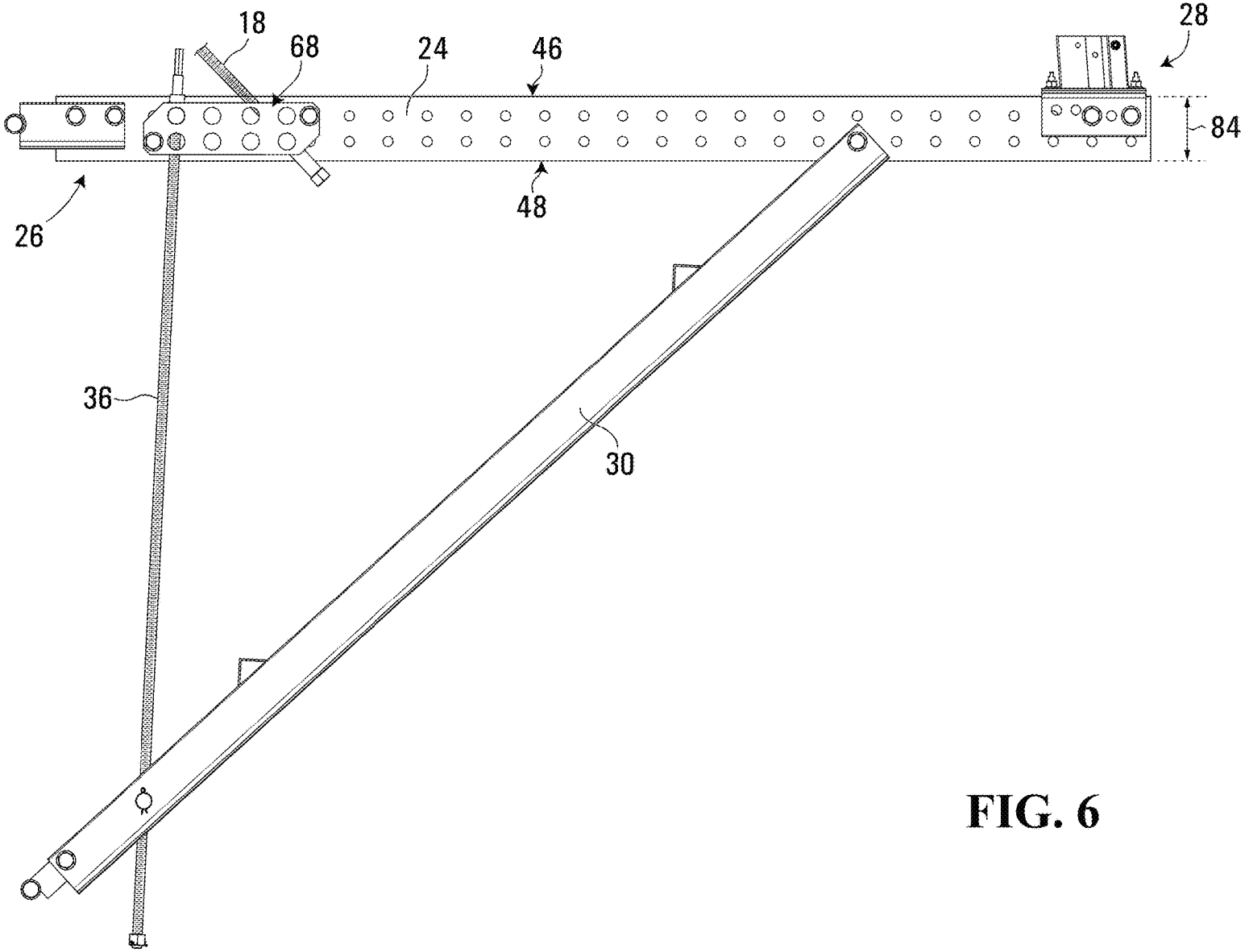
FIG. 6 is a side view of the assembly of FIG. 1 with a channel member removed.
Figure 7:
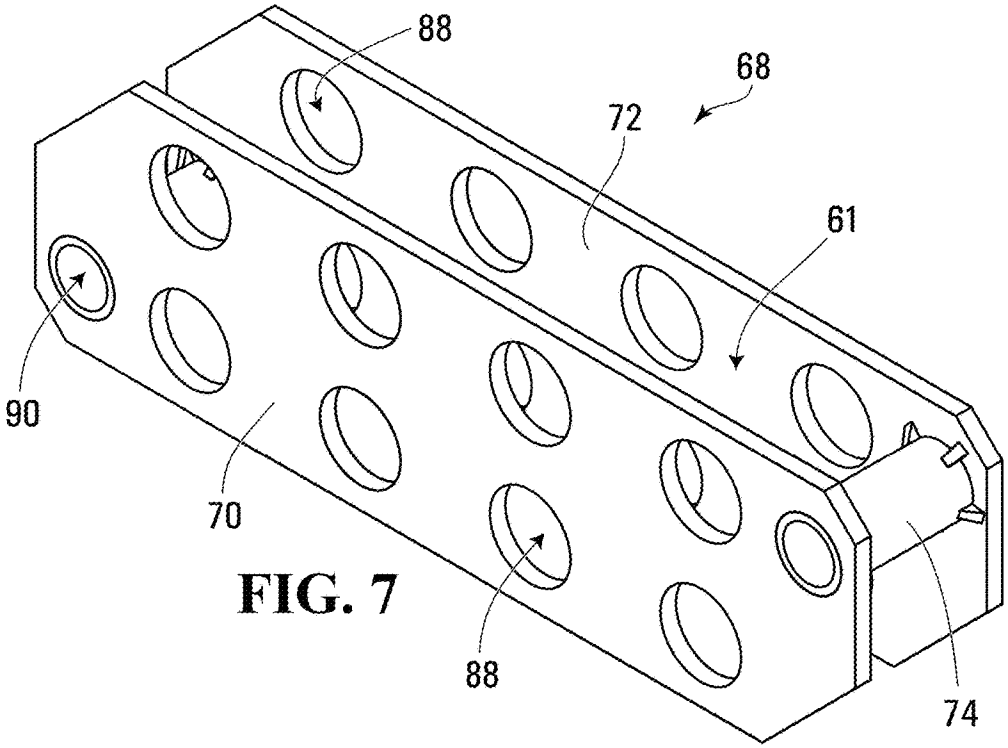
FIGS. 7, 8, 9 and 10 are perspective, bottom, side, and back views, respectively, of a connection element of the assembly of FIG. 1.
Figure 9:
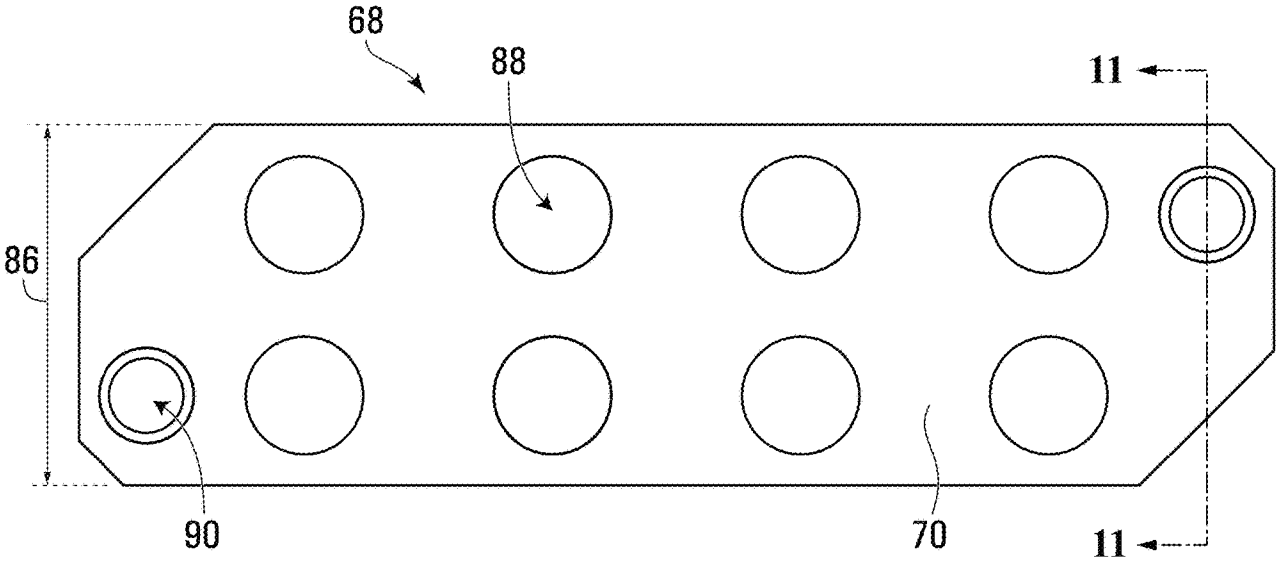

As shown in FIG. 6, the top member 24 has a height 84 between the upper and lower surfaces 46, 48. As shown in FIG. 9, the connection element 68 has a height 86 that is the vertical extent of each of the plates 70, 72. In the example illustrated, the height 86 is substantially less than the height 84. Accordingly, when assembled, as shown in FIGS. 1 and 2, the connection element 68 does not extend beyond, above or below, the upper and lower surfaces 46, 48 of the top member 24. Thus, in use, the longitudinal position of the connection element 68 can be adjusted along top member 24 without interfering with the joist beams 22 (FIG. 1).

In the example illustrated, the plates 70, 72 define eight bores 88. The bores 88 are shown to extend between and are generally orthogonal to the first and second plates 70, 72, from the outer surface 78 to the outer surface 82. In the example illustrated, the plates 70, 72 also include two apertures 90, which are formed through the supports 74. The apertures 90 are shown to extend between and are generally orthogonal to the first and second plates 70, 72, from the outer surface 78 to the outer surface 82. It will be appreciated that, in other examples, the number of bores and the number of apertures can vary.

Figure 8:
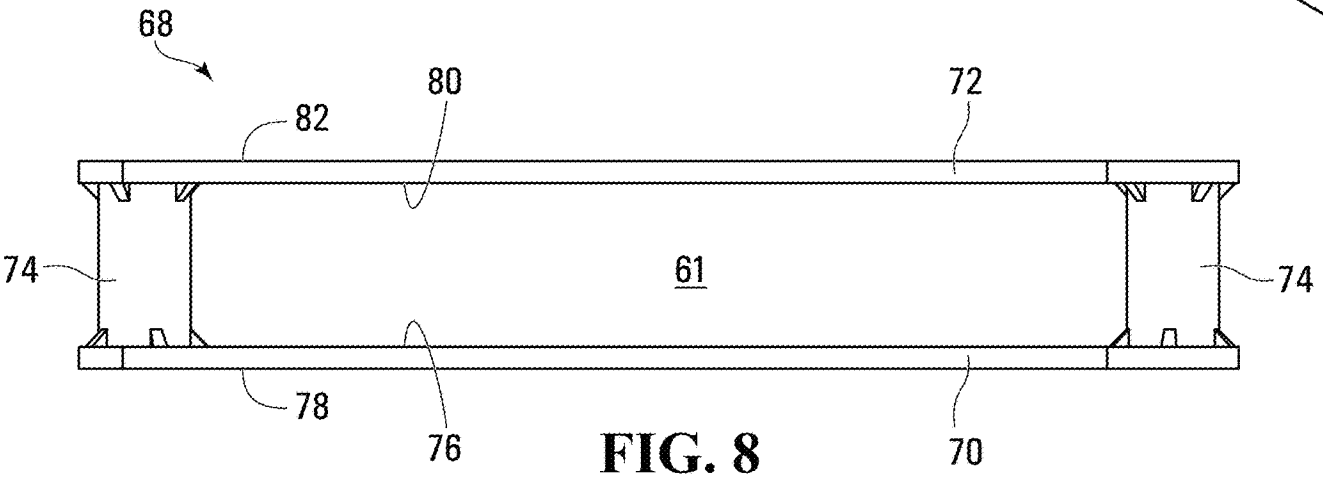
Figure 10:
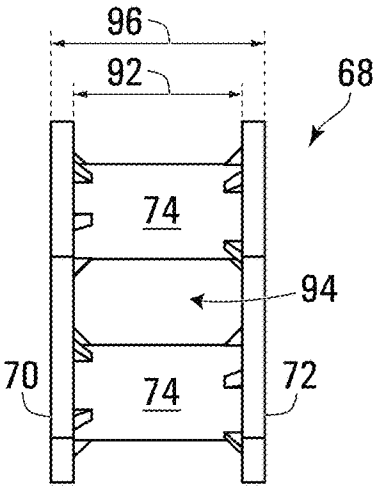
Figure 11:
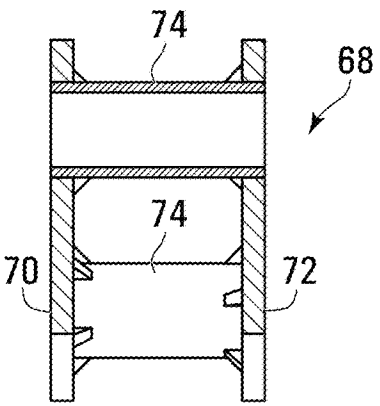
FIG. 11 is a sectional view along line 11-11 of FIG. 9.

Referring to FIGS. 8 and 10, the inner surfaces 76, 80 of the plates 70, 72 are laterally spaced apart a dimension 92 to define an internal space 94. The internal space 94 can accommodate passage of the side member 36 and the tie bar 18 through the connection element 68. The outer surfaces 78, 82 of the plates 70, 72 are laterally spaced apart a dimension 96. Referring again to FIG. 5, the bores 88 are sized and shaped to receive a first pivot pin 98 and a second pivot pin 100 in sliding fit, and so that they are able to rotate within their respective bores 88. The pivot pins 98, 100 can be sized such that they are longer than the dimension 92 but shorter than the dimension 96. Accordingly, when assembled, the inner surfaces 56, 58 of the channel members 52, 54 (FIG. 4) can maintain the pivot pins 98, 100 in their respective bores 88.

Figure 5:
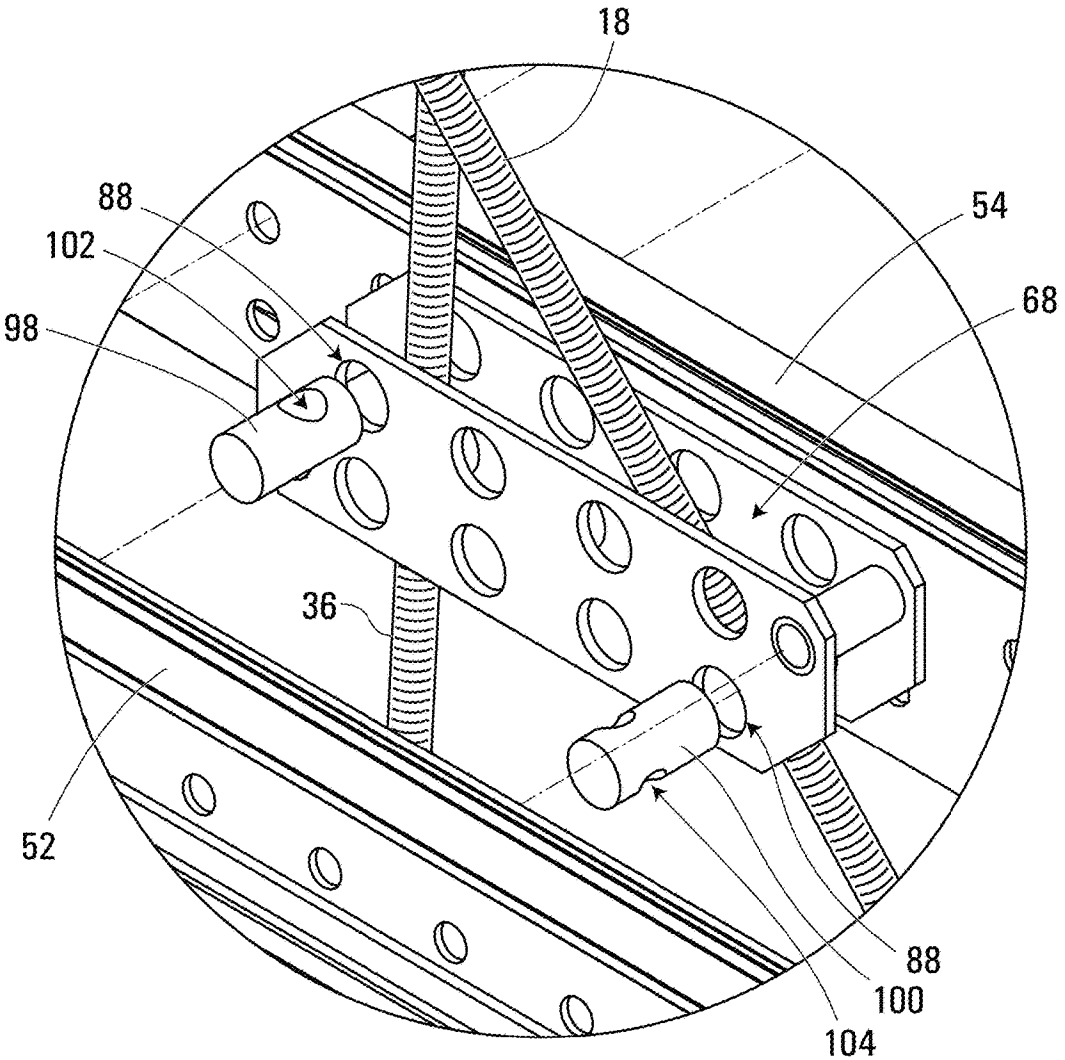
FIG. 5 is a detailed view of a region of FIG. 4.

With continued reference to FIG. 5, the pivot pins 98, 100 are shown to include passages 102, 104. The side member 36 and the tie bar 18 are received by the passages 102, 104 to connect the side member 36 and the tie bar 18 with the connection element 68. In the example illustrated, the passages 102, 104 are laterally offset from one another to provide clearance between the side member 36 and the tie bar 18.

In FIGS. 4 and 5, the side member 36 and the tie bar 18 are shown extending through the connection element 68, and the pivot pins 98, 100 are shown separated from the connection element 68 in this exploded view to aid with understanding. It will be appreciated that, during assembly, the pivot pins 98, 100 can first be inserted into their respective bores 88, and then the side member 36 and the tie bar 18 can be received by the passages 102, 104.

In the example illustrated, the side member 36 and the tie bar 18 each include threaded rods, and the passages 102, 104 can each include corresponding thread engaging elements to engage the threaded rods. In such examples, rotation of the threaded rod of the side member 36 about its axis can cause the pivot pin 98 to move along an axial length of the side member 36, and rotation of the threaded rod of the tie bar 18 about its axis can cause the pivot pin 100 to move along an axial length of the tie bar 18. In other examples, nuts or other fastening hardware can be used to secure the side member 36 and/or the tie bar 18 to the pivot pins 98, 100.

In the example illustrated, the apertures 90 of the connection element 68 receives bolts to fix the longitudinal position of the connection element 68 relative to the top member 24. As illustrated, the channel members 52, 54 can each include an array of holes extending along their lengths to provide a variety of connection points for the connection element 68. In the example illustrated, the channel members 52, 54 each include two horizontal rows of the holes, which are offset vertically.

Figure 12:
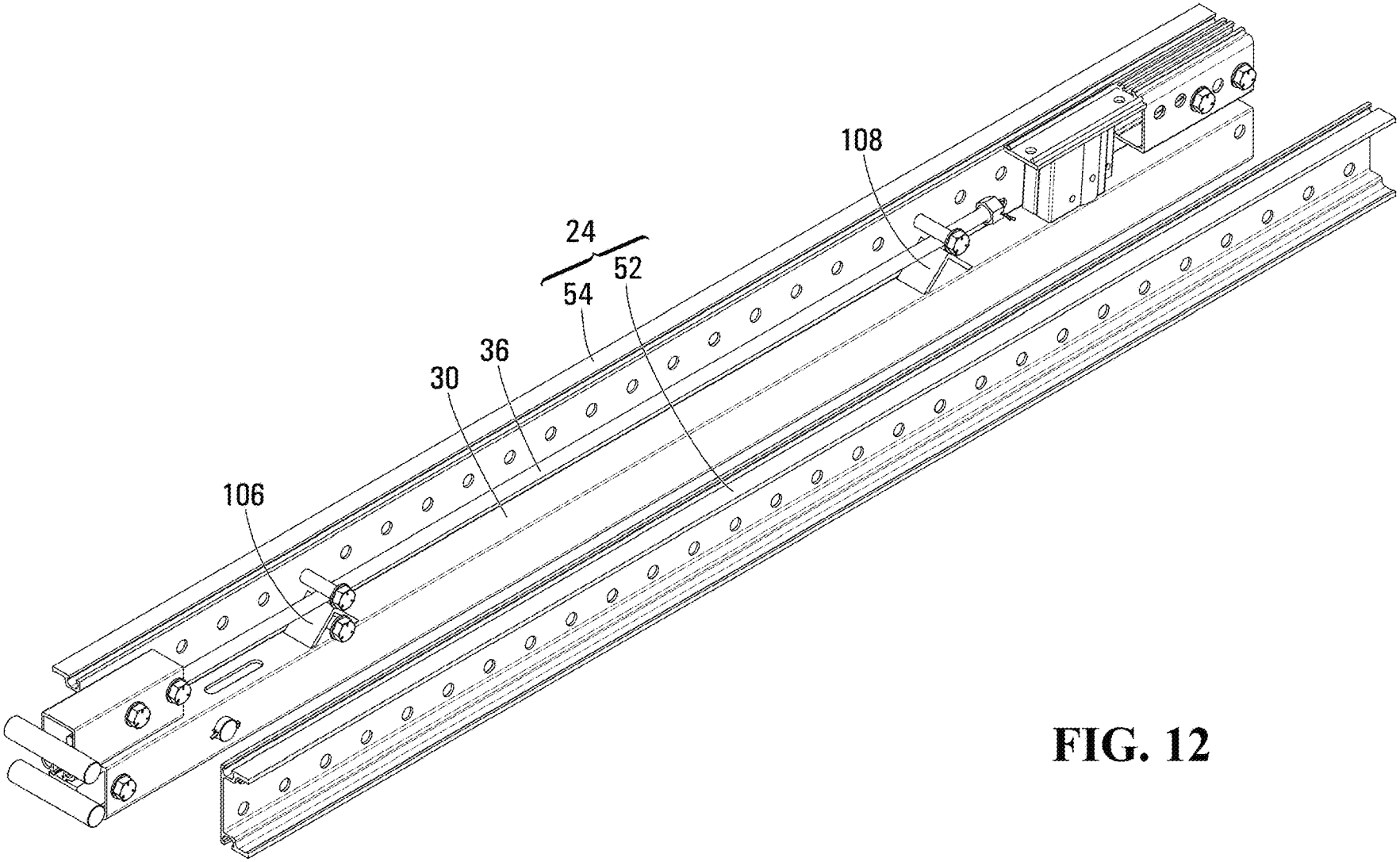
FIG. 12 is an exploded view of parts of the assembly of FIG. 1 shown moved into a shipping/storage position.

Referring to FIG. 12, and with continued reference to FIG. 2, the diagonal and side members 30, 36 are shown pivoted relative to the channel members 52, 54 to achieve a storage/shipping position. In this position, the diagonal member 30 can be generally parallel with the channel members 52, 54, so that the lower and upper ends 32, 34 of the diagonal member 30 are adjacent to the inner and outer ends 26, 28 of the top member 24, respectively.

In the example illustrated, the diagonal member 30 includes connection tabs 106, 108 arranged intermediate the lower and upper ends 32, 34. The connection tabs 106, 108 are configured to receive bolts secured to holes in the channel members 52, 54 to connect the channel members 52, 54 and the diagonal member 30 together in the shipping/storage position. In the example illustrated, the connection tabs 106, 108 are disposed on and stand proud of an upper surface 110 of the diagonal member 30.

Figure 13:
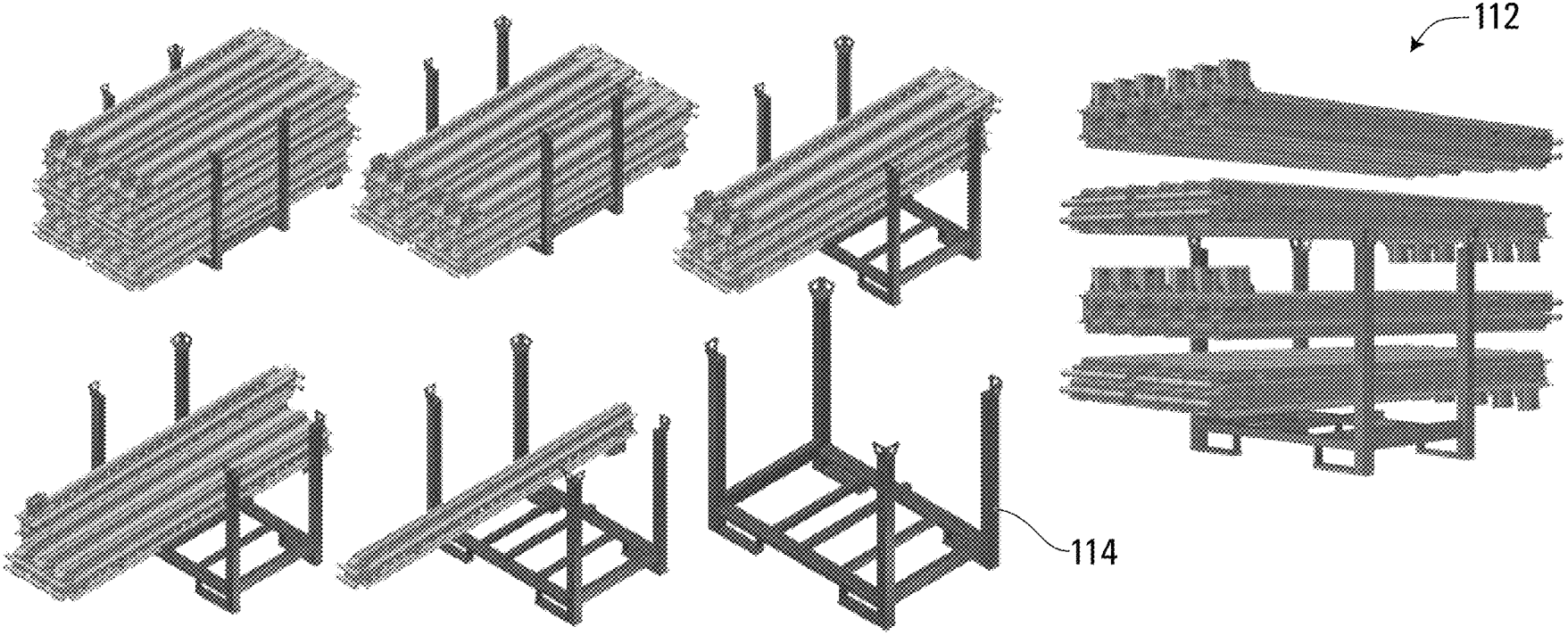
FIG. 13 is a sequence of views showing the assemblies in the shipping/storage position being loaded onto a rack.
Figure 16:
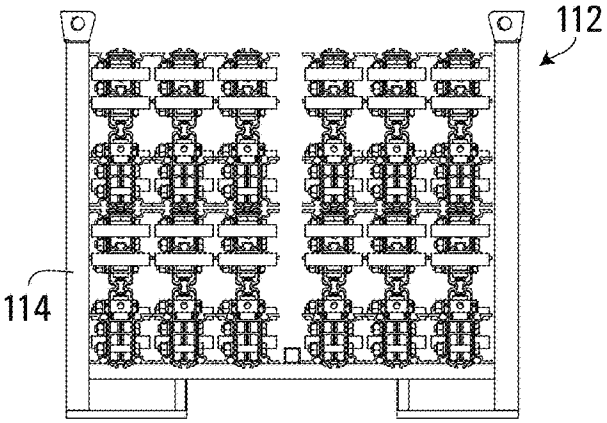
FIGS. 14, 15 and 16 are perspective, side and top views, respectively, of the assemblies in the shipping/storage position loaded onto the rack.
Figure 15:
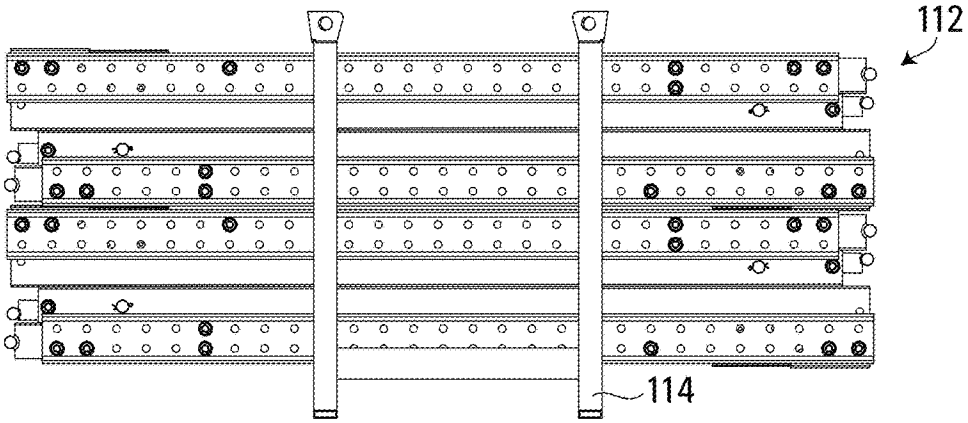
Figure 14:
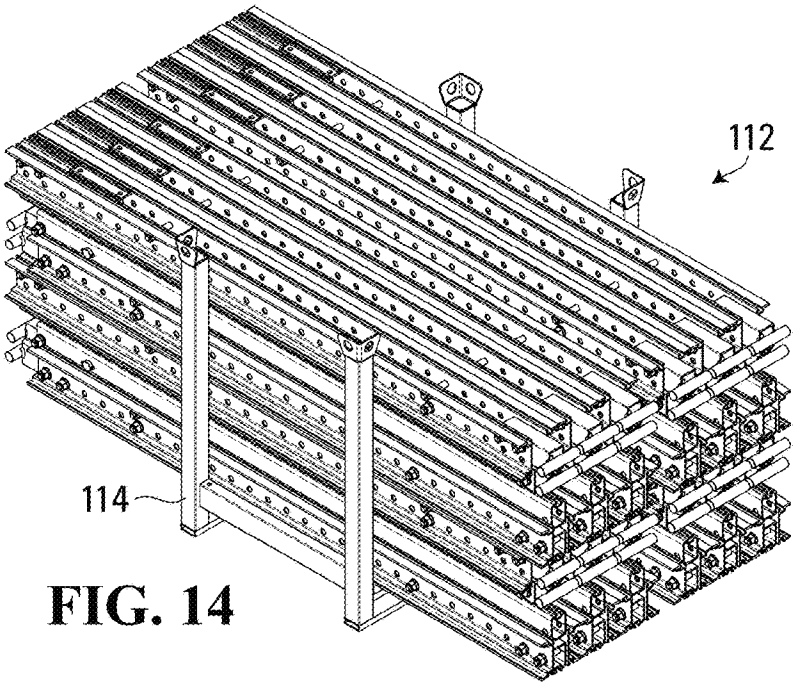
Figure 17:
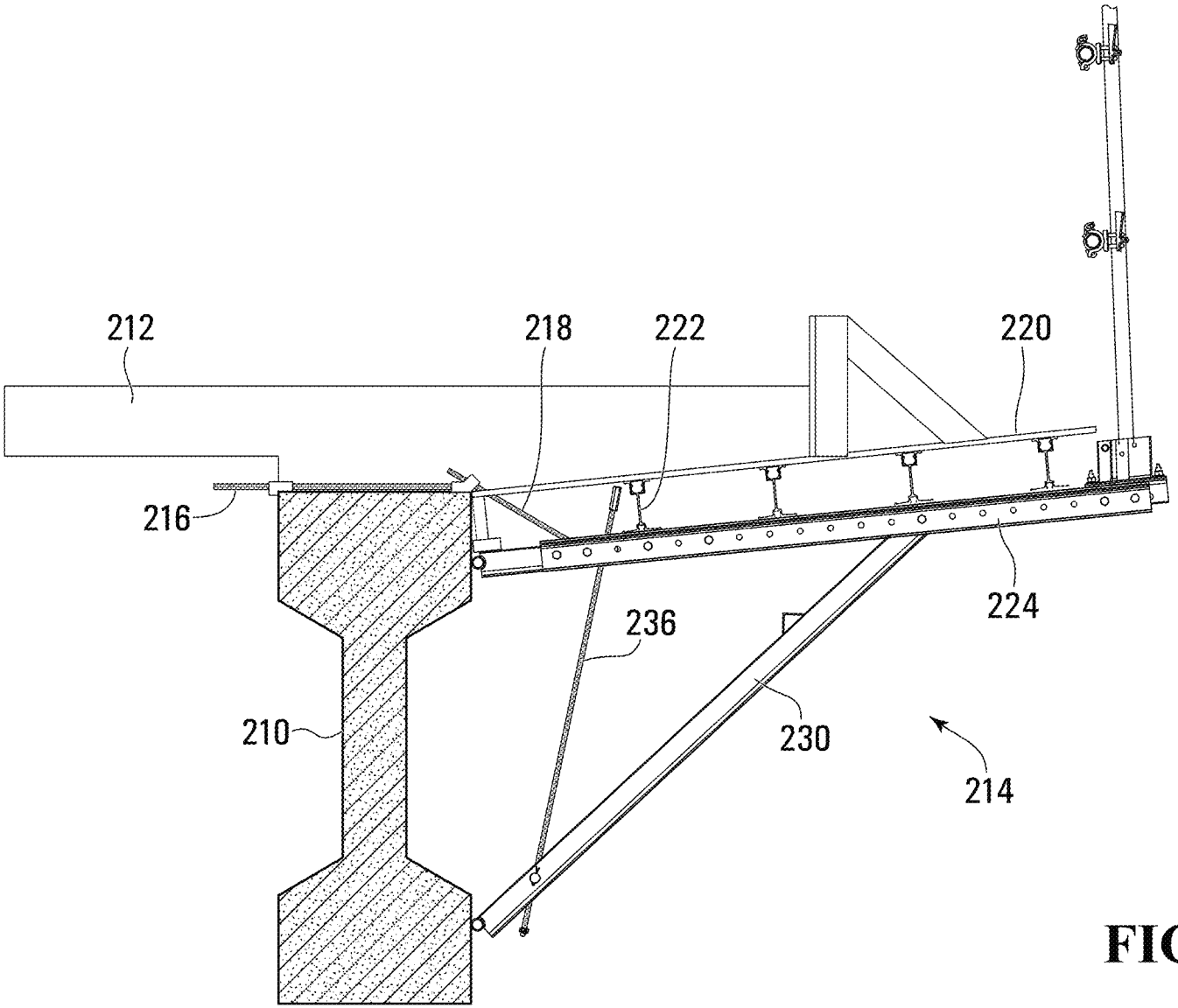
FIG. 17 is a side view of another example of a bridge bracket overhang assembly installed onto a bridge girder/beam.
Figure 18:
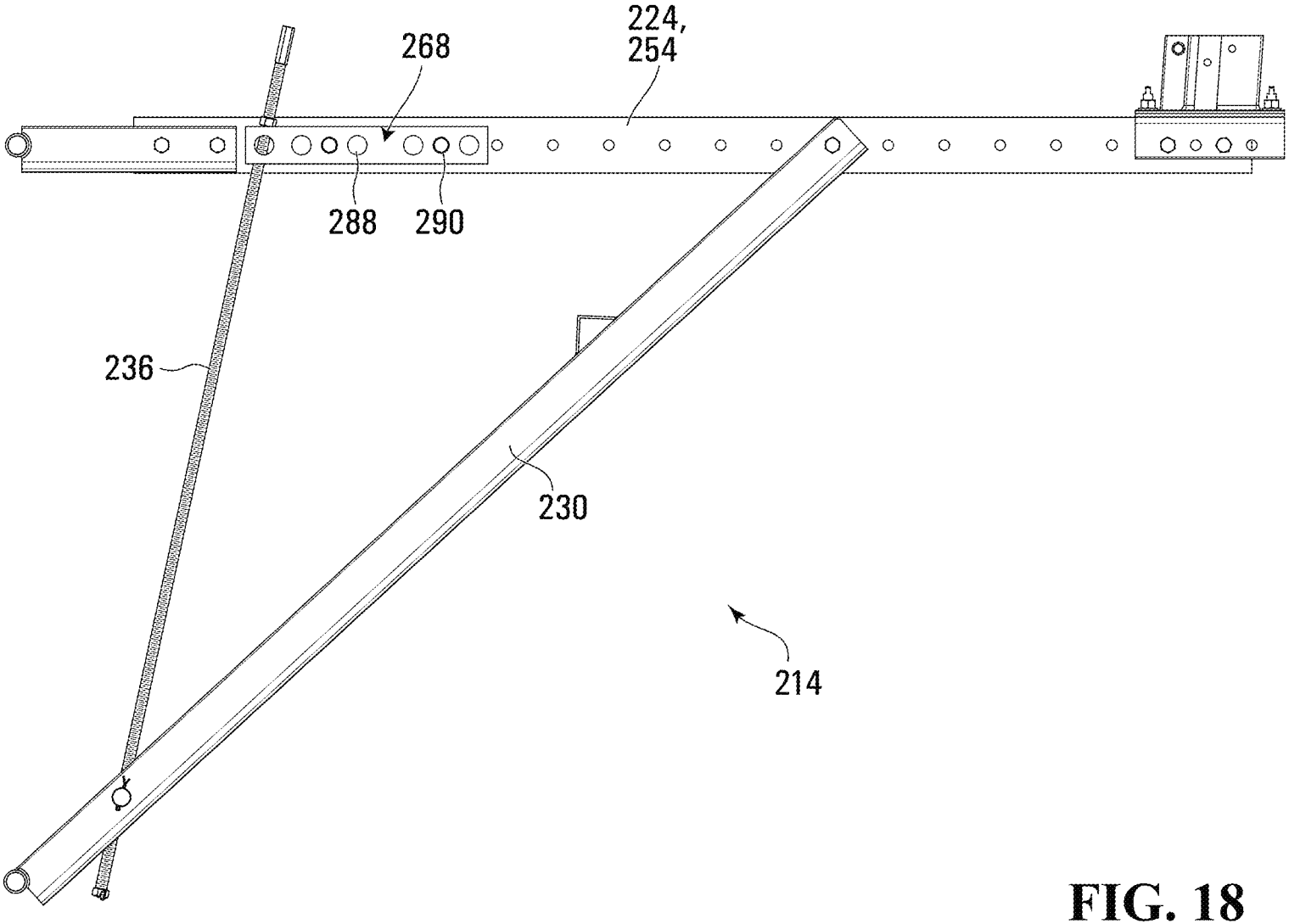
FIG. 18 is a side view of the assembly of FIG. 17 with a channel member removed.
Figure 19:
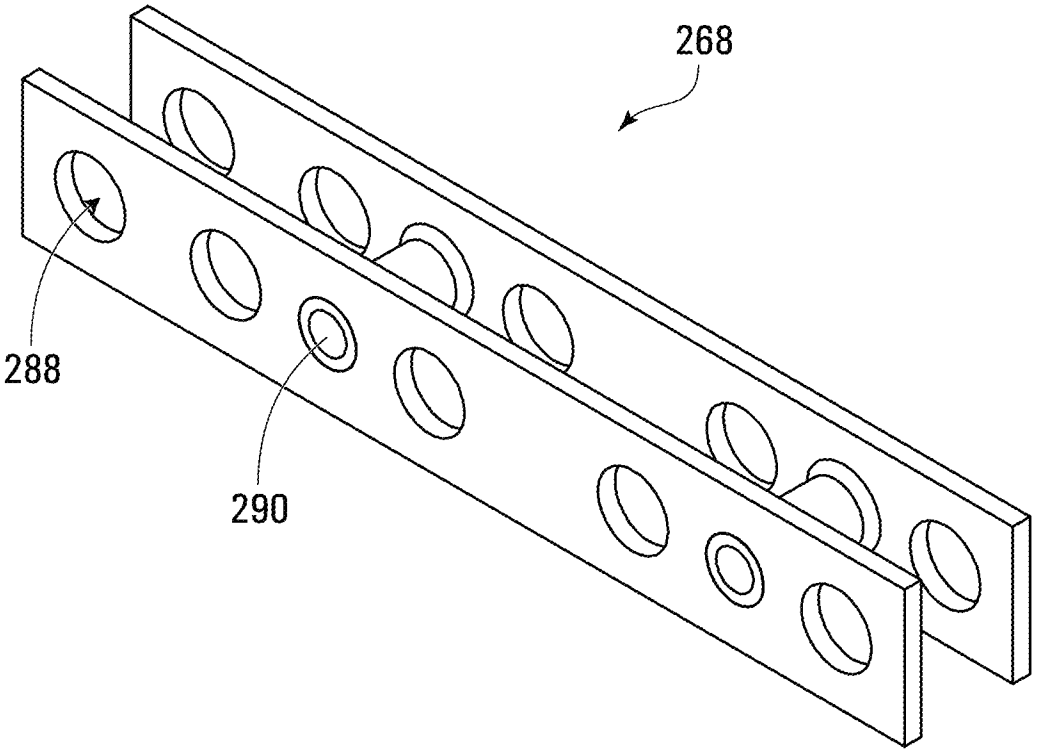
FIG. 19 is a perspective view of a connection element of the assembly of FIG. 17.

Referring to FIG. 13, a plurality of bridge overhang bracket assemblies 112 in the storage/shipping position are shown being stacked onto a rack 114. The rack 114 can be collapsible for separate shipping and storage. The rack 114 can be handled with a standard yard forklift, and with a crane by attaching chains to the lifting lugs provided. FIGS. 14, 15 and 16 further show the assemblies 112 in the storage/shipping position stacked on the rack 114. As illustrated, the storage/shipping position is relatively compact thereby enabling efficient storage and/or shipping.

It will be appreciated that by adjusting the longitudinal position of the connection element 68, the position of the diagonal and side members 30, 36 can be varied quickly and easily, and can be done without disassembling the entire assembly 14.

It will also be appreciated that the connection element 68 can include more than two of the bores 88 to provide a user with multiple locations to place the pivot pins 98, 100. Having the option of where to locate the pivot pins 98, 100 can permit the user to finely adjust the relative locations of the top member 24, the side member 36, and the tie bar 18 to locate the bridge deck support form 20 (FIG. 1) in a precise, desired location. Having eight or more of the bores 88 can also permit the connection element 68 to be moved, for example, to ensure clearance between the supports 74, the side member 36 and the tie bar 18, while still maintaining the pivot pins 98, 100 in the same positions relative to the top member 24.

Referring now to FIG. 12, a concrete beam or girder 210 is shown supporting a bridge deck 212, and another example of an improved bridge overhang bracket assembly is shown generally at reference numeral 214. A hanger rod 216 is affixed to the beam 210, and a tie bar 218 couples the hanger rod 216 and the assembly 214. A bridge deck support form 220 acts as a temporary support surface for the bridge deck 212 during the forming process. The bridge deck support form 220 is connected to the assembly 214 by joist beams 222.

Similar to the assembly 14, the assembly 214 can have four elongate members, namely, a top member 224, a diagonal member 230, a side member 236 and a tie bar 218. However, as illustrated, the top member 224 can include only a single row of holes extending along its length. Correspondingly, the assembly 214 can include a connection element 268, as shown in FIGS. 13 and 14, that provides a single row of horizontally aligned bores 288 and apertures 290. When assembled, the connection element 268 does not extend beyond, above or below, upper and lower surfaces of the top member 224. Thus, in use, the longitudinal position of the connection element 268 can be adjusted along top member 224 without interfering with the joist beams 222 (FIG. 12).

It will be appreciated that by adjusting the longitudinal position of the connection element 268, the position of the diagonal and side members 230, 236 can be varied quickly and easily, and can be done without disassembling the entire assembly 214.

Compared to the assembly 14, the assembly 214 can be configured as a "light duty" version, and can be designed to handle lesser overall loads for smaller bridge overhang installation jobs. For example, and not intended to be limiting, the "heavy duty" assembly 14 can provide a carrying capacity of about 12,000 pounds, and the "light duty" assembly 214 can provide a carrying capacity of about 6,000 pounds.

While the above description provides examples of one or more apparatuses or methods, it will be appreciated that other apparatuses or methods may be within the scope of the accompanying claims.

We claim:

1. A bridge overhang bracket assembly, comprising:

a top member extending lengthwise between a proximal end and a distal end, the top member comprising an upper surface;

a diagonal member extending lengthwise between a lower end and an upper end, the top member and the diagonal member being pivotally attached proximate to the respective distal and upper ends thereof;

a side member extending lengthwise between a bottom end and a top end, the diagonal member and the side member being pivotally attached proximate to the respective lower and bottom ends thereof; and a connection element mounted to the top member and pivotally attached to the top end of the side member, the connection element translatable along the top member for adjusting a longitudinal position of the connection element relative to the top member between the proximal and distal ends thereof, wherein the connection element does not extend above the upper surface of the top member, wherein the top member comprises first and second channel members, each extending lengthwise between the proximal and distal ends of the top member, an inner surface of the first channel member facing and spaced laterally from an inner surface of the second channel member to define a slot, and the connection element is disposed within the slot, and wherein the connection element comprises first and second plates, an outer surface of the first plate arranged to engage the inner surface of the first channel member, and an outer surface of the second plate arranged to engage the inner surface of the second channel member.

2. The assembly of claim 1, wherein the connection element is generally flush with the upper surface of the top member.

3. The assembly of claim 2, wherein the connection element does not extend below a lower surface of the top member.

4. The assembly of claim 3, wherein the connection element is generally flush with the lower surface of the top member.

5. The assembly of claim 1, wherein the connection element comprises:

a plurality of bores extending between and generally orthogonal to the first and second plates; and a first pivot pin received in one of the plurality of bores in sliding fit between the outer surfaces of the first and second plates, the side member being pivotally attached to the first pivot pin.

6. The assembly of claim 5, wherein the first pivot pin comprises a first passage for receiving the side member.

7. The assembly of claim 6, wherein the side member comprises a threaded rod, and the first passage of the first pivot pin comprises a thread engaging element for engaging the threaded rod of the side member, such that rotation of the threaded rod about its axis causes the first pivot pin to move along an axial length of the side member.

8. The assembly of claim 5, comprising a tie bar, and the connection element comprises a second pivot pin received in one of the plurality of bores in sliding fit between the outer surfaces of the first and second plates, the tie bar being pivotally attached to the second pivot pin.

9. The assembly of claim 8, wherein the second pivot pin comprises a second passage for receiving the tie bar, and the second passage is laterally offset relative to the first passage of the first pivot pin.

10. The assembly of claim 9, wherein the tie bar comprises a threaded rod, and the second passage of the second pivot pin comprises a thread engaging element for engaging the threaded rod of the tie bar, such that rotation of the threaded rod about its axis causes the second pivot pin to move along an axial length of the tie bar.

11. The assembly of claim 1, wherein the connection element comprises at least one aperture extending between the first and second plates, the at least one aperture for receiving a respective at least one bolt to fix the longitudinal position of the connection element relative to the top member.

12. The assembly of claim 11, wherein each of the first and second channel members comprises a plurality of holes arranged between the proximal and distal ends, the plurality of holes permitting a plurality of fixed positions of the connection element along the top member.

13. The assembly of claim 12, wherein at least a portion of the plurality of holes are aligned horizontally along the first and second channel members.

14. The assembly of claim 13, wherein at least a portion of the plurality of holes are offset vertically from others of the plurality of holes.

15. The assembly of claim 1, wherein the diagonal member comprises at least one connection tab arranged intermediate the upper and lower ends, the connection tab for receiving a bolt to connect the top and diagonal members together in a shipping/storage position.

16. The assembly of claim 15, wherein the at least one connection tab is disposed on an upper surface of the diagonal member.

17. A bridge overhang bracket assembly, comprising:

a top member extending lengthwise between a proximal end and a distal end, the top member comprising upper and lower surfaces;

a diagonal member extending lengthwise between a lower end and an upper end, the top member and the diagonal member being pivotally attached proximate to the respective distal and upper ends thereof;

a side member extending lengthwise between a bottom end and a top end, the diagonal member and the side member being pivotally attached proximate to the respective lower and bottom ends thereof;

a tie bar extending lengthwise between a first end for attachment to a support structure and a second end; and a connection element mounted to the top member and pivotally attached to the top end of the side member and the second end of the tie bar, the connection element translatable along the top member for adjusting a longitudinal position of the connection element relative to the top member between the proximal and distal ends thereof, wherein the connection element does not extend above the upper surface of the top member or below the lower surface of the top member, wherein the top member comprises first and second channel members, each extending lengthwise between the proximal and distal ends of the top member, an inner surface of the first channel member facing and spaced laterally from an inner surface of the second channel member to define a slot, and the connection element is disposed within the slot, and wherein the connection element comprises first and second plates, an outer surface of the first plate arranged to engage the inner surface of the first channel member, and an outer surface of the second plate arranged to engage the inner surface of the second channel member.

18. The assembly of claim 17, wherein the connection element comprises:

a plurality of bores extending between and generally orthogonal to the first and second plates; and a first pivot pin received in one of the plurality of bores in sliding fit between the outer surfaces of the first and second plates, the side member being pivotally attached to the first pivot pin.

19. The assembly of claim 18, wherein the first pivot pin comprises a first passage for receiving the side member.

20. The assembly of claim 19, wherein the side member comprises a threaded rod, and the first passage of the first pivot pin comprises a thread engaging element for engaging the threaded rod of the side member, such that rotation of the threaded rod about its axis causes the first pivot pin to move along an axial length of the side member.

* * * * *